US005746366A

United States Patent [19]

Hall

[11] Patent Number: 5,746,366

[45] Date of Patent: May 5, 1998

[54] WEAR PLATE POSITIONED GUIDE SHOE

[75] Inventor: Douglas Oliver Hall, Canandaigua, N.Y.

[73] Assignee: Eastman Kodak Company, Rochester, N.Y.

[21] Appl. No.: 599,740

[22] Filed: Feb. 12, 1996

[51] Int. Cl.[6] ..... B65H 20/02; B65H 20/24

[52] U.S. Cl. ..... 226/189; 226/169; 226/183; 242/615.3; 396/617; 396/645

[58] Field of Search ..... 226/91, 169, 183, 226/189; 354/319, 320, 321, 339; 242/615.3; 396/617, 645

[56] References Cited

U.S. PATENT DOCUMENTS

| | | | |
|---|---|---|---|
| 1,979,700 | 11/1934 | May | 226/91 X |
| 2,689,729 | 9/1954 | Debrie | 226/91 |
| 3,694,071 | 9/1972 | Touchette | 354/319 X |
| 4,059,211 | 11/1977 | Brizzolara | 226/91 X |
| 4,272,000 | 6/1981 | Hope et al. | 354/339 X |
| 4,279,495 | 7/1981 | Fukushima et al. | 354/321 |
| 4,833,496 | 5/1989 | Hall | 226/189 X |
| 4,853,728 | 8/1989 | Hall | 354/320 |
| 5,243,373 | 9/1993 | Glover et al. | 354/339 X |

FOREIGN PATENT DOCUMENTS 2 169 267 7/1986 United Kingdom .

*Primary Examiner*—Daniel P. Stodola
*Assistant Examiner*—Gregory J. Strimbu
*Attorney, Agent, or Firm*—Edward Dugas

[57] ABSTRACT

A flexible web guiding apparatus including; a turnaround roller; a pinch roller positioned in driving engagement with said turnaround roller and defining a nip therebetween; and a web guide for accurately directing an end of the web into the nip defined by the turnaround roller and the pinch roller to cause the web to move between the pinch roller and the turnaround roller without stubbing against either roller. The accuracy of the web guide is achieved by wear plates that are affixed to the web guide and spaced apart to permit the web to move therebetween. The wear plates are maintained in friction contact with the turnaround roller for controllably maintaining the spacing between the web guide and the turnaround roller.

10 Claims, 3 Drawing Sheets

WEAR PLATE POSITIONED GUIDE SHOE

FIELD OF INVENTION

The invention relates generally to the field of web transport devices that use stationary guide shoes, and in particular to stationary guide shoes that by design require one edge of the guide shoe to be a specified distance from a rotating roller.

BACKGROUND OF THE INVENTION

During the processing of X-ray films, and specifically in the developer section, the silver halide film is very sensitive to any deviation in the transport speed of a roller rack processor. In a typical turn-around assembly the film passes between spring loaded opposing rollers. If the leading edge of the film stubs on either roller it can cause a momentary hesitation of the film. This hesitation can cause what is known as a stub line in one or more locations on the film from a roller further back along the film transport. To aid in the reduction of this stubbing, the edge of the guide shoe is positioned very close to the nip of the opposed rollers. The distance from the edge of the guide shoe to the master roller is critical. This invention improves the ease of assembly, reduces the cost to the product, aids in the adjustment both at original manufacture and in field service, and compensates for any out of round defects between the master roller and the guide shoe.

The current method used to accomplish the positioning and adjustment of the guide shoe incorporates the use of a locking plate for the guide shoe support on the rack side plate. To adjust, the guide shoe support is loosened, the guide shoe assembly is twisted to the desired position, the guide shoe support is re-tightened, and the locking plate is then tightened. This takes care of one end of the guide shoe and then the process is repeated on the other side. When the opposite end is adjusted the original end often moves out of position. This creates an iterative process that is often time consuming. An additional problem occurs due to the turn-around assembly not being rigid to twist along the assembly's long axis. The twisting of the assembly whether done purposely or inadvertently, can cause the guide shoe adjustment to change. U.S. Pat. No. 4,833,496, entitled, "Web Guiding Apparatus", by Douglas O Hall, the inventor of the present invention, and U.S. Pat. No. 4,853,728, entitled "X-Ray Film Processor Rack" also by Douglas O Hall, show web guiding systems wherein the wear plates of the present invention find particular utility.

SUMMARY OF THE INVENTION

The present invention is directed to overcoming one or more of the problems set forth above. Briefly summarized, according to one aspect of the present invention there is provided an improved web guiding apparatus for use with a flexible web, comprising:

- a turnaround roller;
- a pinch roller positioned in driving engagement with said turnaround roller and defining a nip therebetween;
- a guide means positioned to direct the end of the web into the nip defined by said pinch roller and said turnaround roller; and
- a wear plate affixed to said guide means and maintained in friction contact with said turnaround roller for controllably maintaining a spacing between said guide means and said turnaround roller.

The above and other objects of the present invention will become more apparent when taken in conjunction with the following description and drawings wherein identical reference numerals have been used, where possible, to designate identical elements that are common to the figures.

Advantageous Effect Of The Invention

The present invention has the advantage of more consistently transporting a web of material in a smooth manner so as to minimize hesitations in the motion of the web which tend to cause artifacts. Additionally, the present invention maintains a precision alignment of mechanical components irrespective of variations in manufacturing tolerances and/or wear while providing an easily adjustable assembly.

DETAILED DESCRIPTION OF THE INVENTION

Figure 1:
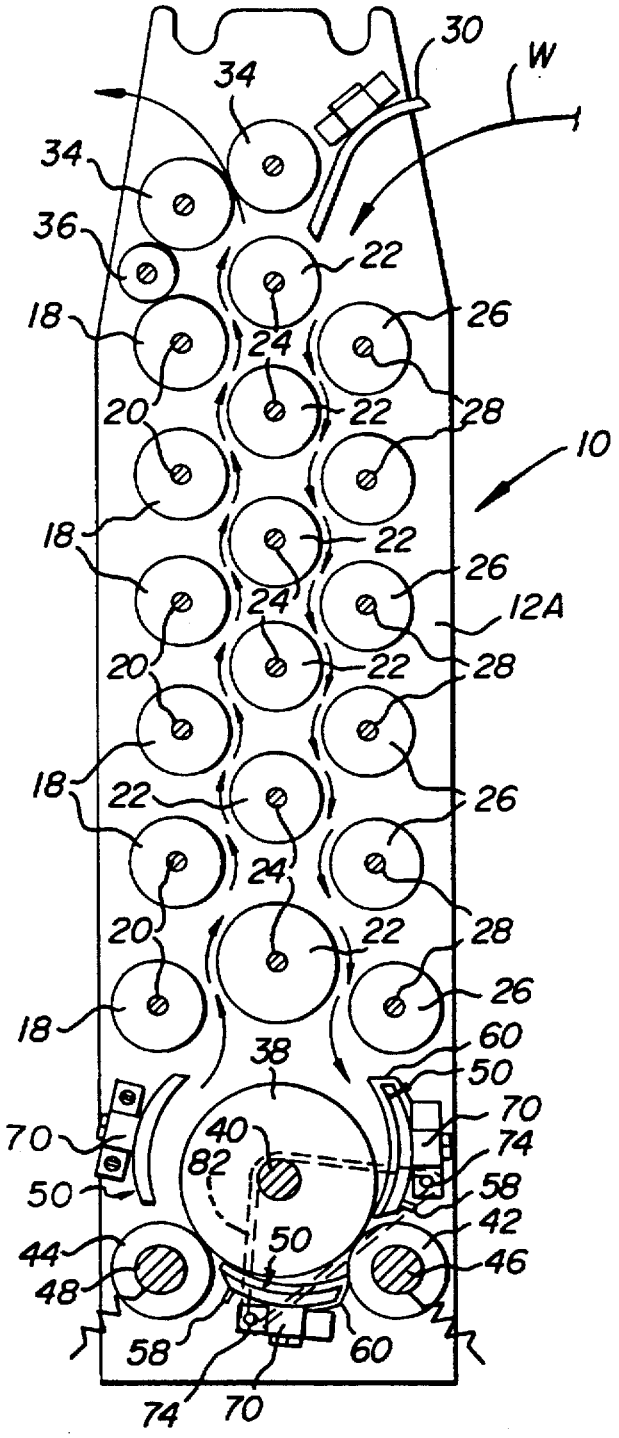
FIG. 1 is a side elevation view of a film processor roller rack showing the film path, film rollers, and film guides.

Referring to FIG. 1, a roller rack 10 for a film processor is constructed with a back side plate 12A and a spaced apart therefrom front side plate 12B (see FIG. 5) that is removed in the drawing to reveal the internal parts of the roller rack 10. For simplicity, reference will be made to the components interfacing with the back side plate 12A knowing that the components also interface with the front side plate in a like manner. A first group of rollers 18 are rotatably mounted on the back side plate 12A and the front side plate (not shown) by means of suitable shafts 20 extending between the side plates. The first group of rollers 18 are positioned so that their respective axis of rotation extend horizontally, one under the other, and lie in a single vertical plane to form a first vertically aligned array of parallel spaced rollers. In a similar manner, second and third groups of rollers 22 and 26 are individually rotatably supported on shafts 24 and 28, respectively, to form second and third aligned groups of parallel spaced rollers.

Each of the rollers in the first, second, and third groups are interconnected by a number of gear wheels (not shown) in a manner well known in the art. These gear wheels are rotated at the same speed by an appropriate drive means (not shown). The arrangement between the gear wheels and the first, second and third groups of rollers is such that the first and third groups of roller 18 and 26 are rotated in the same direction and the second group of rollers 22 are rotated in an opposite direction as indicated by arrows in FIG. 1. Thus the second and third group of rollers 22 and 26 will cooperate to move a film or paper web W downward and rollers 18 and 22 will cooperate to move the film or paper web upward as indicated by the arrows to define a downward film path and a return upward film path.

The web W is directed into the roller rack 10 and into the downward film path by a curved guide 30 attached to the back side plate 12A. The web W exits the upper path through a pair of nip rollers 34 one of which is engaged by a rewet roller 36.

Referring now to the lower portion of the roller rack 10, a turnaround roller 38, rotably supported on a shaft 40, is positioned below the three groups of rollers 18, 22, and 26 to provide a web turnaround path. A pair of pinch (drive) rollers 42 and 44 are rotatably mounted on shaft 46 and 48, respectively, and are spring biased into engagement with the periphery of the turnaround roller 38 to drive the turnaround roller 38.

A first curved film guide shoe 50 is positioned to the right of turnaround roller 38 and is pivotly supported on the back side plate 12A by a support block 70 to direct the end of the film web into the nip between roller 38 and roller 42. A second like curved film guide shoe 50 is positioned between rollers 42 and 44, and is pivotly supported on the back side plate 12A by a support block 70 to direct the end of the web W into the nip between rollers 44 and 38. A curved guide shoe 84 is positioned to the left of the turnaround roller 38 to serve to deflect the web W into the upward film path defined by roller groups 18 and 22. The curved guide shoe 84 may be of the type disclosed in U.S. Pat. No. 4,833,496. A spring 82 is placed around the shaft 40 and projecting posts 74 provided on the support blocks 70 to maintain wear plates 60 in contact with the surface of the turnaround roller 38. Each guide shoe 50 is provided with an adjusting screw 58 to move one end of the wear plate 60 with respect to the guide shoe 50 to accommodate for physical wear in the wear plate 60. The wear plates 60 are made from a low surface friction material with a low rate of wear.

Referring now specifically to the function of the wear plates 60, the position of their curved surface 62 relative to the turnaround roller 38 and to pinch rollers 42 and 44 is critical and tight tolerances must be maintained. More specifically, if the edges of the first and second guide shoes 50 closest to the adjusting screws 58 are not spaced closely to the surface of turnaround roller 38 and in close proximity to the nip of rollers 38–42, and 38–44, respectively, the leading edge of the film will stub against roller 42 and/or roller 44 resulting in scratching of the film emulsion. Only through maintenance of extremely tight tolerances can this result be avoided.

Figure 2:
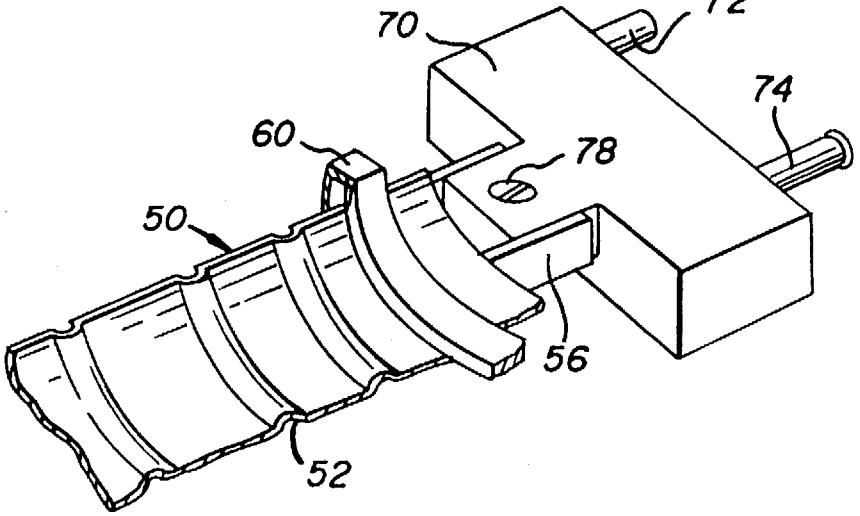
FIG. 2 is a perspective view of a wear plate attached to a typical guide shoe.
Figure 3:
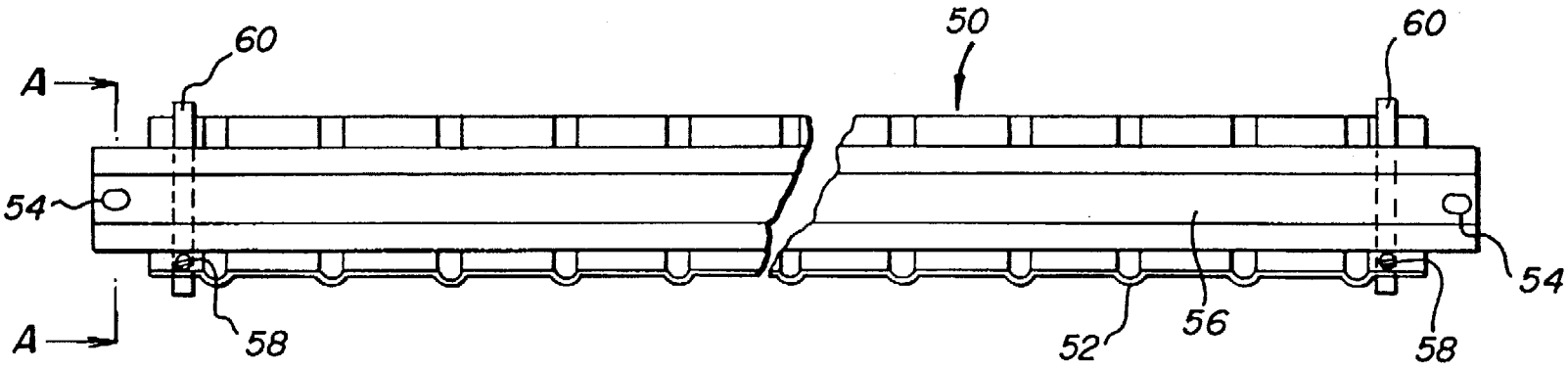
FIG. 3 is a top view of a guide shoe assembly.
Figure 4:
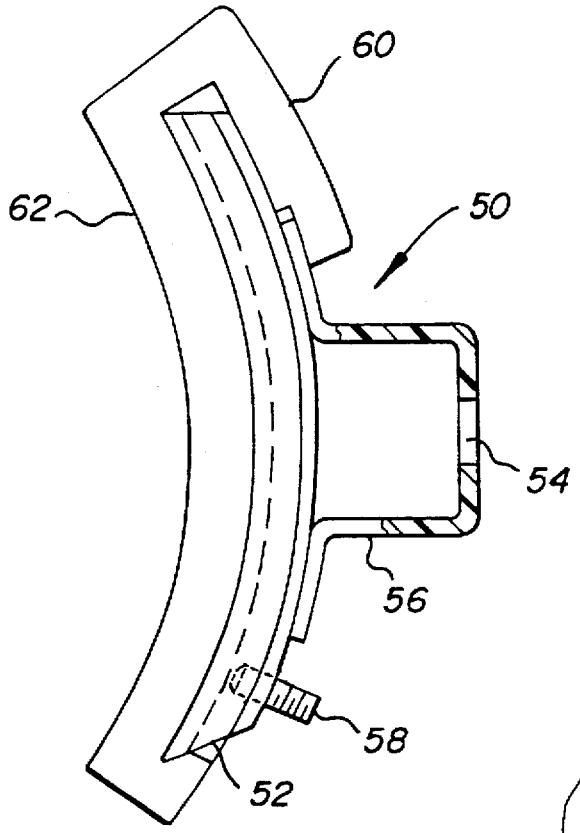
FIG. 4 is a sectioned view taken along the section lines A—A in FIG. 3.
Figure 5:
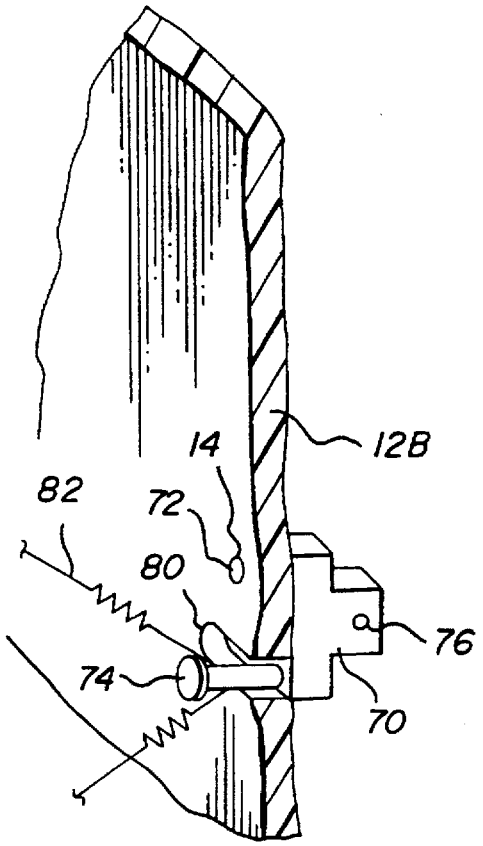
FIG. 5 is a cut-away perspective view illustrating the positioning of the guide assembly's support block with respect to a portion of the processor roller rack's front side plate.

Referring to FIGS. 2, 3, and 4, the guide shoe 50 is mounted to a pivotal support block 70 that is positioned in the roller rack side plates 12A and 12B (see FIGS. 1 and 5). The support block 70 has a pivot post 72 that acts as a pivot point for the block and a projecting post 74 around which the spring 82 is wrapped. The wear plates 60 are positioned on each end of each guide shoe 50 and are captured between the guide shoe 50 and the turnaround roller 38. The turnaround roller 38 has a rigid core, usually of stainless steel, that the wear plates 60 slide against. An adjusting screw 58 is threaded through the guide shoe 50 and presses against the end of the wear plate 60 nearest the nip of the opposed rollers. The adjusting screw 58 is self-locking and accessible without disassembling the rack. At each end of guide shoe 50 there is a hole 54 that receives a fastener 78 for attaching the guide shoe 50 via the hole 76 (see FIG. 5) to the support block 70. The guide shoe 50 is provided with a generally "U" shaped stiffener 56 to prevent bending along its long axis. Additionally, the guide shoe 50 is formed with a plurality of ridge-like projections 52 on which the web of material rides as it travels around the turnaround roller 38. The wear plates 60 are positioned on the guide shoe 50 at a spacing that is greater than the width of the web of material such that the web material moves between the wear plates 60 and in contact with the turnaround roller 38.

Referring now to FIG. 5, the front side plate 12B is shown having a hole 14 there through to receive the pivot post 72 projecting form the support block 70. A slot 80 is provided in the back side plate 12B to receive the block's projecting post 74. The spring 82 is schematically shown urging the support block 70 to pivot around the pivot post 72 to maintain contact between the wear plates 60 and the surface of the turnaround roller 38.

The invention has been described with reference to a preferred embodiment. However, it will be appreciated that variations and modifications can be effected by a person of ordinary skill in the art without departing from the scope of the invention.

I claim:

1. A web guiding apparatus for use with a flexible web, comprising:

a turnaround roller;

a pinch roller positioned in driving engagement with said turnaround roller and defining a nip therebetween, a guide means, including a guide shoe, positioned to direct an end of the web into the nip defined by said pinch roller and said turnaround roller; and a wear plate affixed to said guide shoe and maintained in friction contact with said turnaround roller for controllably maintaining a spacing between said guide shoe and said turnaround roller.

2. The web guiding apparatus as claimed in claim 1 wherein said wear plate is a curved plate formed of low surface friction material with a low rate of wear.

3. The web guiding apparatus as claimed in claim 1 and further comprising adjusting means for adjusting the position of the wear plate in response to physical wear.

4. The web guiding apparatus as claimed in claim 1 and further comprising:

a second pinch roller positioned in driving engagement with said turnaround roller;

said second pinch roller defining a second nip with said turnaround roller;

a second guide means for directing the end of the web toward the second nip; and said turnaround roller; and a second wear plate affixed to said second guide means and maintained in friction contact with said turnaround roller for controllably maintaining the spacing between said second guide means and said turnaround roller.

5. The web guiding apparatus as claimed in claim 4, wherein the second guide means includes a second guide shoe, and wherein the second wear plate is affixed to the second guide shoe of the second guide means.

6. A web guiding apparatus comprising:

a turnaround roller;

a pinch roller positioned in driving engagement with said turnaround roller and defining a nip with said turnaround roller;

a guide means comprising a guide shoe including a central surface for slidable engaging a web of material along a width of the web and for directing an end of the web into the nip defined by said pinch roller and said turnaround roller so as to cause the web to move between said pinch roller and said turnaround roller; and a pair of wear members affixed to opposing ends of the central surface of said guide shoe, said pair of wear members maintained in friction contact with said turnaround roller for controllably maintaining a spacing between said guide shoe and said turnaround roller.

7. The web guiding apparatus as claimed in claim 6, where said pair of wear members each comprise a curved plate formed of low surface friction material with a low rate of wear.

8. The web guiding apparatus as claimed in claim 6, further comprising adjusting means for adjusting the position of the wear members in response to physical wear.

9. The web guiding apparatus as claimed in claim 6, further comprising: a further pinch roller positioned in driving engagement with said turnaround roller and defining a further nip with said turnaround roller, and wherein said guide means includes a further guide shoe including a central surface for slidable engaging the web of material along its width and directing the end of the web into the further nip defined by said further pinch roller and said turnaround roller so as to cause the web to move between said further pinch roller and said turnaround roller.

10. The web guiding apparatus as claimed in claim 6, wherein said guide means further includes a final guide shoe including a central surface for slidable engaging the web of material along its width and directing the end of the web to a return path as the web passes between said further pinch roller and said turnaround roller.

* * * * *

UNITED STATES PATENT AND TRADEMARK OFFICE

CERTIFICATE OF CORRECTION

PATENT NO. : 5,746,366
DATED : May 5, 1998
INVENTOR(S) : Douglas Oliver Hall

It is certified that error appears in the above-indentified patent and that said Letters Patent is hereby corrected as shown below:

On the First Page of the Patent, Related U.S. Application Data:
insert --Provisional Application No. 60/002,796, August 25, 1995--.

Column 3, line 17, delete "84" and insert --50--.

Column 3, line 20, delete "84" and insert --50--.

Signed and Sealed this

Twenty-eighth Day of July, 1998

*Attest:*

*Attesting Officer*

BRUCE LEHMAN

*Commissioner of Patents and Trademarks*